US010555595B2

(12) United States Patent
Grisar

(10) Patent No.: US 10,555,595 B2
(45) Date of Patent: Feb. 11, 2020

(54) HANGING CHAIR HAVING A SPREADING STICK

(71) Applicant: LA SIESTA GMBH, Jugenheim (DE)

(72) Inventor: Leonid Grisar, Essenheim (DE)

(73) Assignee: LA SIESTA GMBH, Jungenheim (DE)

( * ) Notice: Subject to any disclaimer, the term of this patent is extended or adjusted under 35 U.S.C. 154(b) by 3 days.

(21) Appl. No.: 16/048,823

(22) Filed: Jul. 30, 2018

(65) Prior Publication Data

US 2019/0328115 A1 Oct. 31, 2019

(30) Foreign Application Priority Data

Apr. 25, 2018 (DE) ..... 20 2018 102 328 U

(51) Int. Cl.
*A45F 3/22* (2006.01)
*A47C 3/02* (2006.01)

(52) U.S. Cl.
CPC . *A45F 3/22* (2013.01); *A47C 3/02* (2013.01)

(58) Field of Classification Search
None
See application file for complete search history.

(56) References Cited

U.S. PATENT DOCUMENTS 4,188,063 A * 2/1980 Dusart ..... A47C 3/0255 297/273
5,097,545 A * 3/1992 Hooi ..... A47D 9/02 297/274
5,490,478 A * 2/1996 Cole ..... A01K 1/03 119/28.5
5,531,656 A * 7/1996 Varghese ..... A47D 13/105 297/274
5,729,844 A * 3/1998 Kerstetter ..... A47D 13/105 297/274
5,944,381 A * 8/1999 Nguyen ..... A47D 13/105 297/281
6,701,549 B1 * 3/2004 Eriksen ..... A45F 3/22 5/120
7,040,995 B2 5/2006 Lee
9,226,564 B1 * 1/2016 Cross ..... A45F 3/22
2009/0091165 A1 * 4/2009 Thompson ..... A47C 31/11 297/228.12

(Continued)

FOREIGN PATENT DOCUMENTS

CA 2507775 A1 * 11/2006 ..... A45F 3/22
CN 202932284 5/2013

(Continued)

*Primary Examiner* — David E Allred
(74) *Attorney, Agent, or Firm* — Hauptman Ham, LLP

(57) ABSTRACT

A hanging chair having a spreading stick and drawstring tunnels on the hanging chair surface for receiving suspension strings. The base section of the hanging chair surface of the hanging chair has at least one approximately rectangular seat surface and a trapezoidal back surface attached to the seat surface. The seat surface and back surface have common continuously connected drawstring tunnels on the lateral edges. The lateral drawstring tunnels of the seat surface and back surface bring about, by suspension strings guided therein, a lateral gathering of the entire hanging chair surface. The gathering on the suspended hanging chair forms a steeper profile of the back surface with respect to the flatter extending seat surface.

5 Claims, 4 Drawing Sheets

(56) References Cited

U.S. PATENT DOCUMENTS

Figure 1:
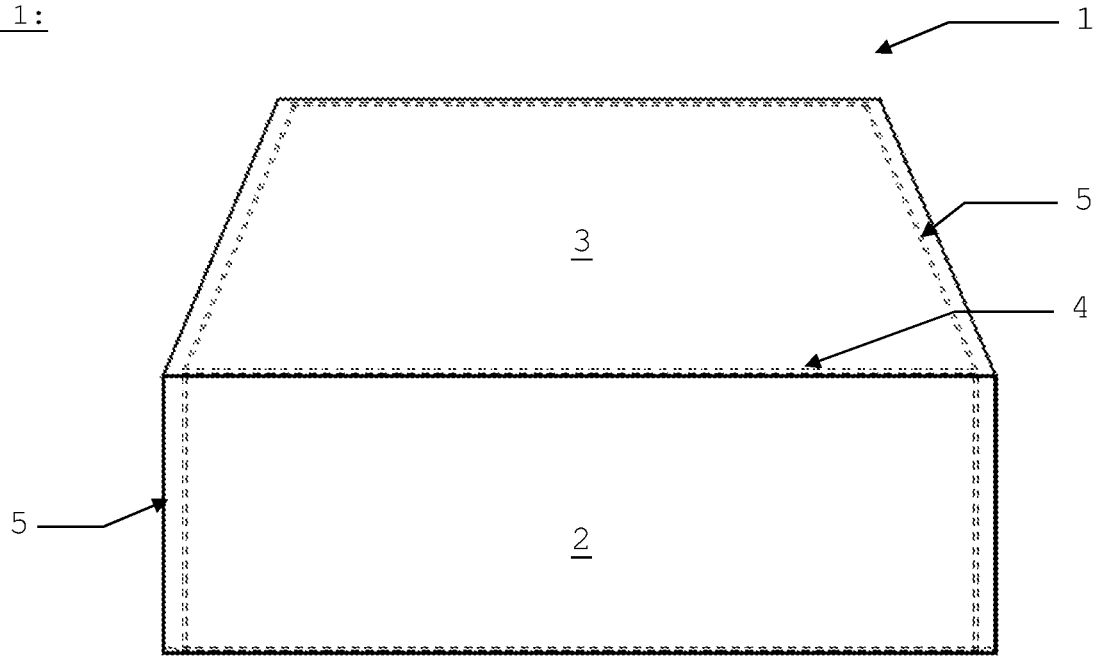

| | | | | |
|---|---|---|---|---|
| 2011/0241397 | A1* | 10/2011 | Spencer | A01M 31/02 297/273 |
| 2016/0007757 | A1* | 1/2016 | Chen | A47C 27/081 297/452.3 |

FOREIGN PATENT DOCUMENTS

| | | |
|---|---|---|
| DE | 20 2004 003 135 | 7/2004 |
| DE | 20 2006 010 623 | 8/2006 |

* cited by examiner

HANGING CHAIR HAVING A SPREADING STICK

RELATED APPLICATIONS

The present application claims the priority of German Application No. 20 2018 102 328.4, filed Apr. 25, 2018, which is incorporated herein by reference in its entirety.

The invention relates to a hanging chair in accordance with the preamble of claim 1.

Hanging chairs constitute a welcome alternative to seating furniture, in particular in the outdoor sector, since they combine the advantages of the hammock with the seating comfort of a chair. They accordingly serve for relaxation and have the advantage that, while neglecting the underlying surface, they can be used by means of simple suspension, for example on the branch of a tree. They thus promote well-being and a healthy posture by strengthening the back.

The use of hammocks and hanging chairs is also expedient in the therapeutic sector, for example in the case of sensory disturbances which are positively countered by the pleasantly perceived pressure of the hanging chair on the body. The gentle movement of the hanging chair also promotes a sense of equilibrium and brings about relaxation.

It is precisely the case that hammocks are a welcome accompaniment on travels since a comfortable lying possibility can thus be created without great effort and with little luggage. This would also be expedient for a further development of the hanging chair by creating a hanging chair which, likewise through a high degree of mobility combined at the same time with an achievable seating comfort, constitutes a genuine alternative to hammocks and to portable chair-like constructions.

Publication CN 202932284 U discloses a hanging chair which is fastened to a spreading stick for suspension. What is concerned here is a seat shell which is fastened to the spreading stick via laterally attached fastening cords. An additional leg rest is arranged in a swing-like manner as a separate support on dedicated fastening cords.

A disadvantage with such designs is, on the one hand, a lack of comfort since what is concerned here is a rigid seat shell which does not have the positive properties of a hammock in terms of comfortableness. In addition, this is not a product suitable as a hanging chair since there is no possibility of compressing this hanging chair in an adequate manner and reducing it to a small pack size.

A further hanging chair arrangement is presented in disclosure U.S. Pat. No. 7,040,995 B2. What is concerned here is a hanging chair stand in which there is also depicted, for example, a hanging chair itself which consists of a continuous surface with lateral cords. A particular subdivision into back part and seat surface is not provided by the base section, nor it is evident that compressibility can be achieved here for use as a travel hanging chair.

Further customary designs of hanging chairs are disclosed in disclosures DE 20 2004 003 135 U1 and DE 20 2006 010 623 U1. These are in both cases hanging chairs which are supported by a plurality of spreading bars. Thus, one spreading bar is transverse to the orientation of the hanging seat. In addition, there are further spreading bars which are intended to orient the hanging seat construction in its upright form and in particular to spread apart the seating mat such that an easy entry and exit can be achieved here. The spreading bars extending in the seating direction thus open the actual seating mat for the user. Also disclosed here is a separate rest for the feet that is suspended on a dedicated spreading stick.

Overall, it is also disadvantageous with these widespread basic constructions that a use as a hanging chair is possible only to a limited degree. The plurality of spreading bars required here and also the complexity of the string guides require relatively large amounts of material which then form an obstacle to use as a hanging chair on account of the ballast.

Against this background, the object of the present invention is to provide a hanging chair having a spreading stick which can be installed with little effort and at the same time brings about improved stabilization when sitting in the hanging chair through an angled profile between the back surface and seat surface. It is intended here for the hanging chair to have a high degree of compressibility and thus be designed such that it can be readily carried along.

This is achieved according to the invention by a hanging chair having a spreading stick as claimed in claim 1.

The further subclaims relate to advantageous refinements of the hanging chair according to the invention.

This inventive object is achieved by a novel base section of the hanging chair. Here, the base section provides, on the one hand, a rectangularly formed seat surface which is adjoined on its first longitudinal edge by a trapezoidally extending back surface. In a further embodiment of the invention, there is additionally provided an extension portion which, while widening trapezoidally, adjoins the second longitudinal edge of the seat surface in order to form an extended support for the legs of the person sitting in the hanging chair.

An essential aspect of the invention here is that the described surfaces of the hanging chair are connected in the base section of a common hanging chair surface, with the different surfaces being connected to one another by common lateral drawstrings tunnels on their transverse edges. This brings about, on the one hand, through the gathering of the drawstring tunnels in the arrangement on the spreading stick, a novel orientation of the different surfaces which achieves a more pleasant seating in the hanging chair since the back surface extends in a straightened-up manner by virtue of its tapering profile, but the extension portion extends in a flattened-off manner toward the horizontal by virtue of its widening.

In addition, this base section causes this effect to be achieved without additional lateral suspension cords which are customary in the prior art. This increases the safety of the hanging chair since injuries on these suspension cords, for example during a use by children, can thus be safely excluded.

Here, in one design form of the hanging chair according to the invention, it has proved to be an advantageous development not to cut these two surface elements from one piece but here to connect two sheet-like elements by a seam line. A connecting seam between the seat surface and the trapezoidal back surface ensures that, when suspending the hanging chair, there occurs along this seam an angling of these two surface elements which are essential for the comfortableness of the hanging chair. By contrast to a standard hammock, a hanging chair is intended precisely to ensure a more upright, more seat-like position which nevertheless has the comfortableness and thus the advantages of a hammock. It has been found here that the connecting seam according to the invention supports the different functions, which support the body, of the seat surface and of the back surface.

In spite of the connecting seam, it is required according to the invention that the two surfaces, that is to say the seat surface and back surface, are connected by common drawstring tunnels extending on the lateral edges. These drawstring tunnels thus extend on the lateral edge of the back surface from its upper edge to the front edge of the seat surface. If, then, the suspension strings are guided through these drawstring tunnels for suspension and fastening on the spreading stick, there occurs a gathering of the hanging chair along its lateral edges into the desired comfortable seat form.

The base section consisting of the rectangular shape and the trapezoidal shape is then changed to a seat shell-like shape by the suspension strings guided in the drawstring tunnels, wherein, in particular by the tapering of the trapezoidal shape toward the upper edge of the back surface, the latter extends steeper while being angled from the horizontal and thus supports the back of the person sitting in the hanging chair. Here, the suspension strings guided through the drawstring tunnels are fastened to the spreading stick extending transversely to the sitting orientation of the person, with the result that the spreading stick performs the function of holding the hanging chair in an opened position. In addition, the spreading stick extending transversely above the person sitting in the hanging chair allows easy entry and exit from the hanging chair.

In addition, the hanging chair according to the invention can be still considerably improved in its comfort function by a supplementation of the base section in that the seat surface is extended, with the result that a more comfortable sitting is also made possible by a supporting of the stretched-out legs of a person sitting in the hanging chair. For this purpose, with regard to the base section described above consisting of the rectangular seat surface and trapezoidal back surface, an extension portion is attached to the longitudinal edge of the seat surface that is opposite the back surface, which extension portion in turn extends trapezoidally, yet now, by contrast with the back surface, widens with respect to the width of the seat surface. In other words, starting from the width of the seat surface, this connecting portion widens trapezoidally, which means that upon suspension this portion basically forms an extension of the horizontal surface of the seat surface.

It is also advantageous here if this portion, as a separate surface element, is also attached to the seat surface by a connecting seam. The extension portion is thus readily compressible along this connecting seam with respect to the seat surface, in particular during a use as a pure hanging chair without support of the legs. In other words, it is only by stretching out the legs into this extension portion that the latter is unfolded and fulfills the desired widened support function. Otherwise, it can remain adjacent to the seat surface along the connecting seam in gathered form.

Since what is concerned is a solution which also claims in itself to be lightweight and movably transportable on account of small dimensions, it is expedient that the spreading stick according to the invention is not configured as a one-part component but consists of a product which can be disassembled into individual components. Here, in one exemplary design form, a width of the assembled spreading stick of approximately 100 cm is provided. For easier transport with the folded-up hanging chair, said spreading stick is then subdivided for example into five partial segments with a length of in each case about 20 cm. For this purpose, there is provision that the spreading stick has plug connections which can produce the complete spreading stick again from the five individual segments. It should be noted at this point that other overall lengths and segmentations may also be expedient and no restriction is intended here.

In addition, an advantageous embodiment of the spreading stick can be such that these individual component parts are connected to one another by means of an elastic band. It is ensured in this way that none of the component parts of the spreading stick gets lost during assembly and disassembly because they are connected to one another by the common elastic band. The elastic band here extends within the component parts and thus also guides the component parts securely in one another through its tensile force when they are pushed together and prevents the component parts from being able to unintentionally slide apart during use. In addition, a self-explanatory, error-free assembly of the spreading stick is thus achieved without the need for assembly instructions.

In addition, the use according to the invention of a plurality of surface elements connected by connecting seams also makes it possible here for the different surfaces of the hanging chair to be formed by different textile materials. This can, on the one hand, be an aspect which serves, on the one hand, for visual appearance but also at the same time has the effect that it is possible for example to quickly distinguish the seat surface from the back surface and that the hanging chair can thus be used in a simple and self-explanatory manner.

The assembly of the hanging chair from a plurality of parts, by at least form the seat surface and back surface, additionally allows these parts to be formed so as to be clearly separated from one another in terms of color and by a seam. This can simplify the use of the hanging chair and also result in an advantageous design.

However, on the other hand, there is advantageously provision that, for example, the elasticity of different materials supports the corresponding design function of the surface component. It can also be advantageous for the less-loaded extension portion adjoining the seat surface to be produced from a thinner and lighter material, since the seat surface has to bear the main weight of the person sitting in the hanging chair. It is thus possible, for example, to achieve a material saving and, associated therewith, a more compact package and hence a suitability of the hanging chair as a travel hanging chair. In principle, the separation provides the flexibility of using different materials, which can have decorative or functional reasons, with it being possible to provide differences in the material used beside the elasticity, for example in the structure, material thickness, surface nature and/or color.

Finally, the connecting seam acts as a reinforcement of the seat part. A continuous material surface for the seat surface and back surface can become worn more quickly. This problem arises in particular with very soft and lightweight materials such as nylon which can have an increased tendency to yield. However, it is precisely these materials which are also expediently used for the hanging chairs presented since they promote their mobile use and transport.

For this mobile use and transport, it is additionally advantageous that the hanging chair, by virtue of said features, can be carried along in a very compact and space-saving manner, for which purpose there is provided a material packaging which can accommodate the entire package consisting of hanging chair surface, holding strings and suspension and also the disassembled or folded spreading stick.

Figure 2:
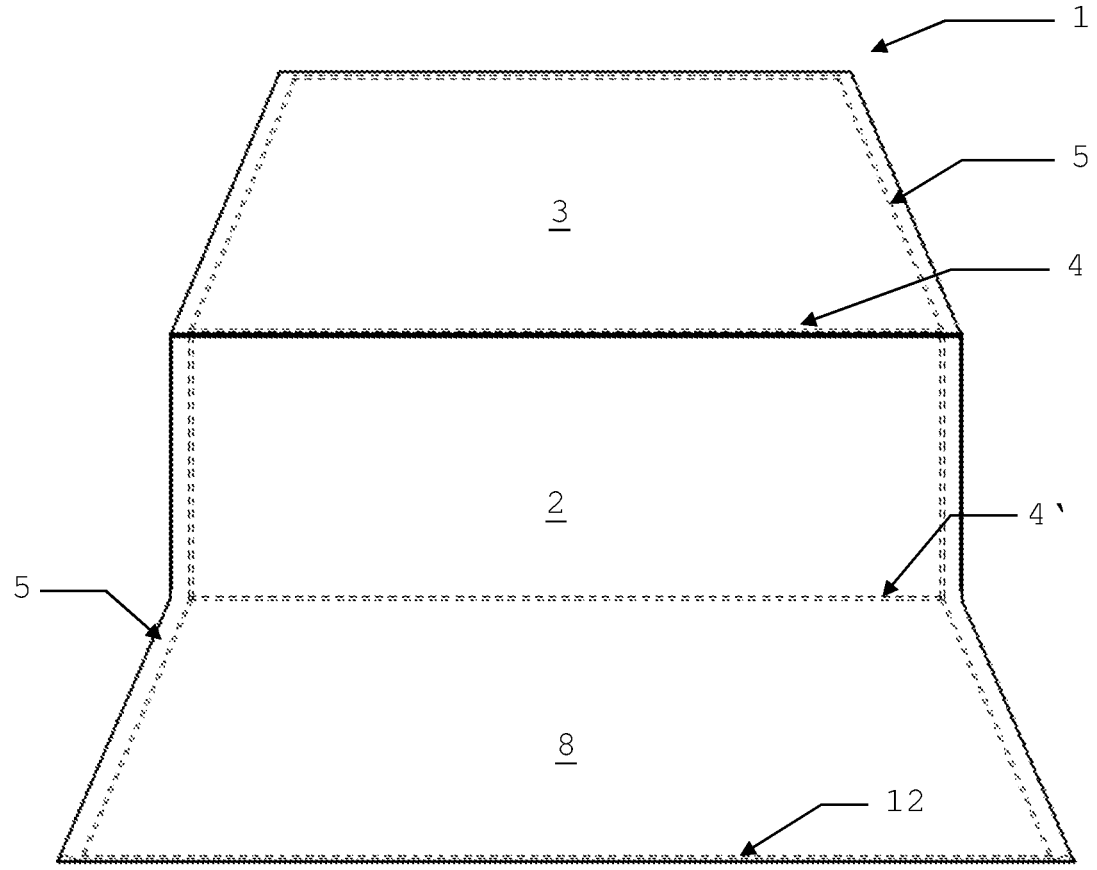
Figure 3:
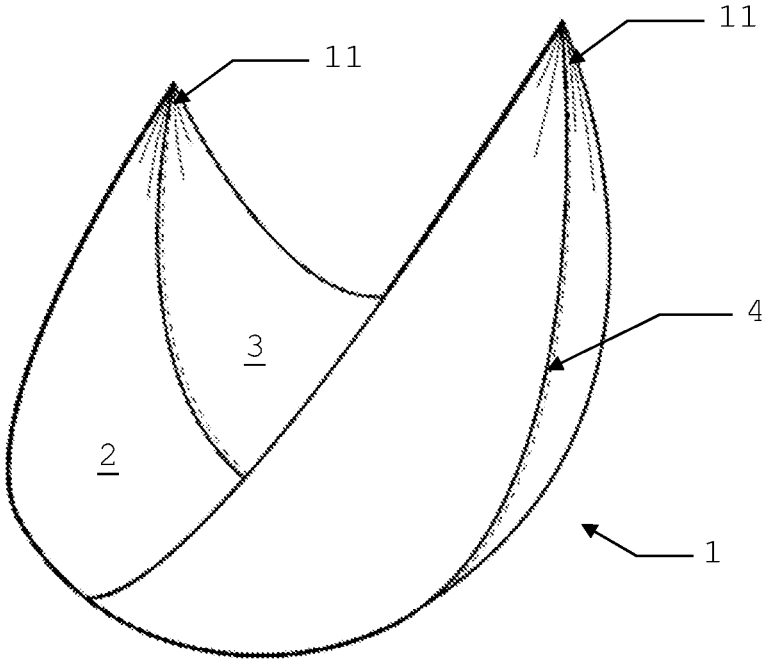
Figure 4:
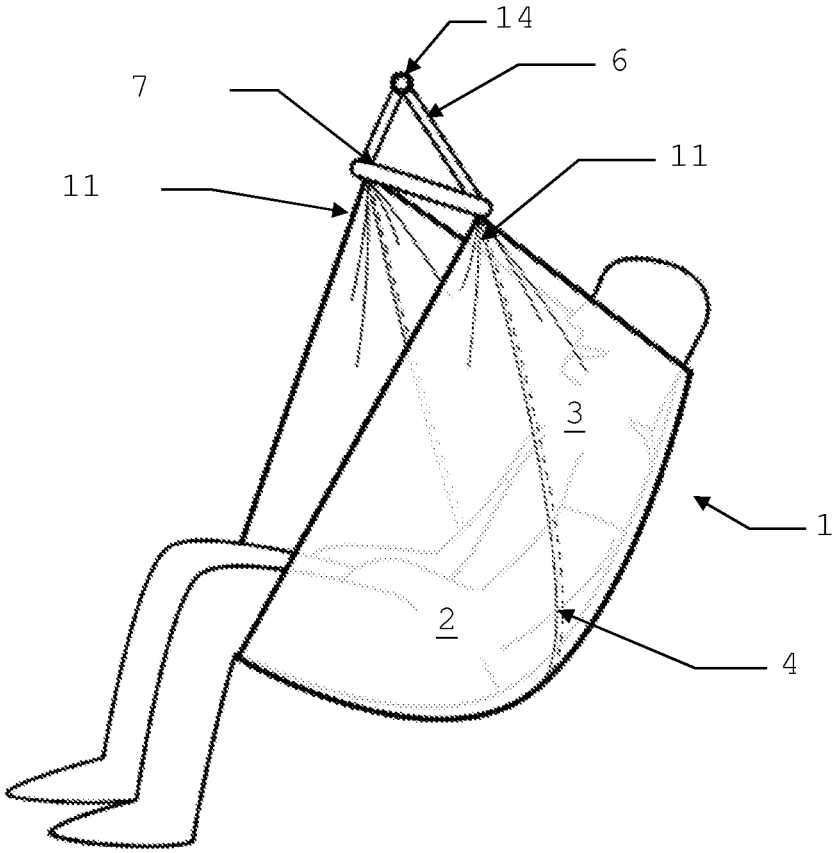
Figure 5:
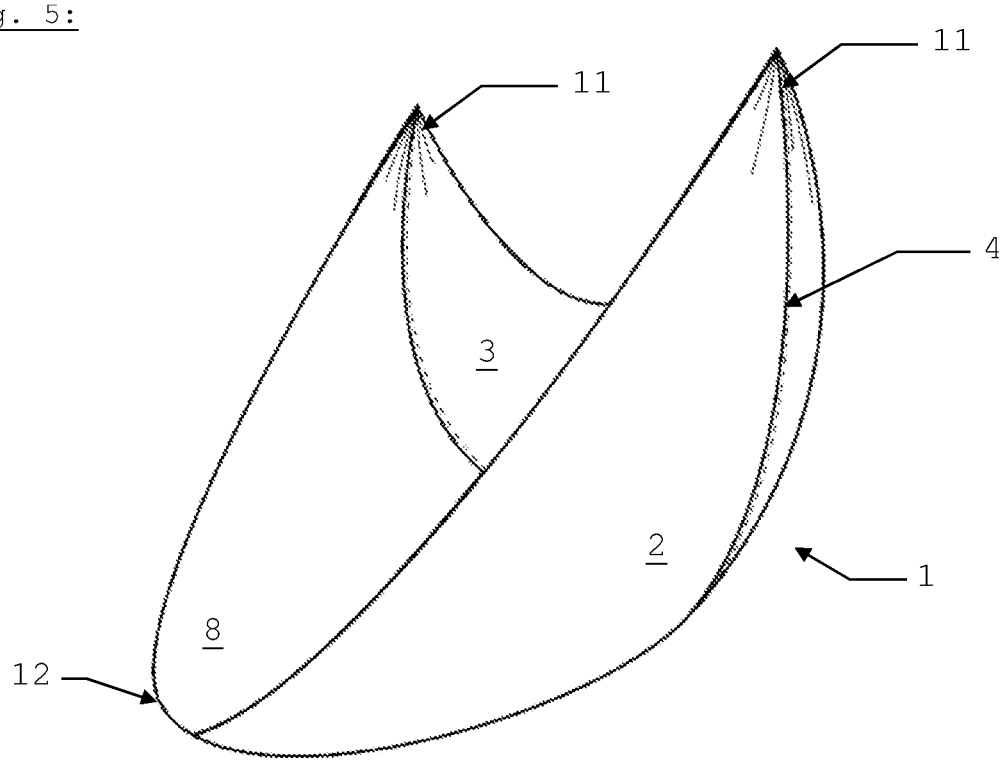
Figure 6:
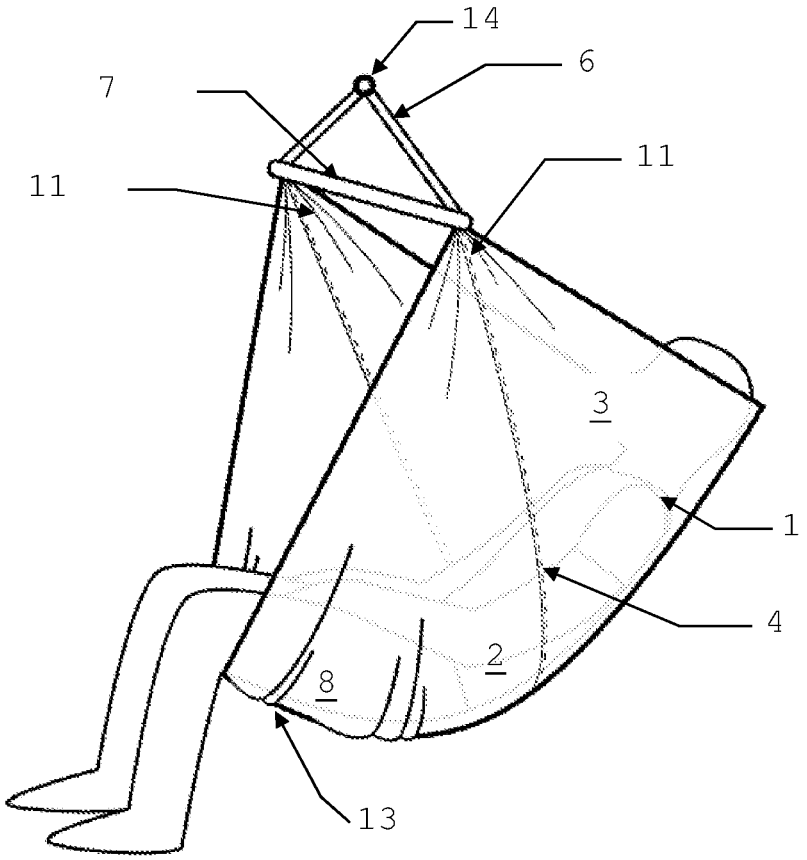
Figure 7:
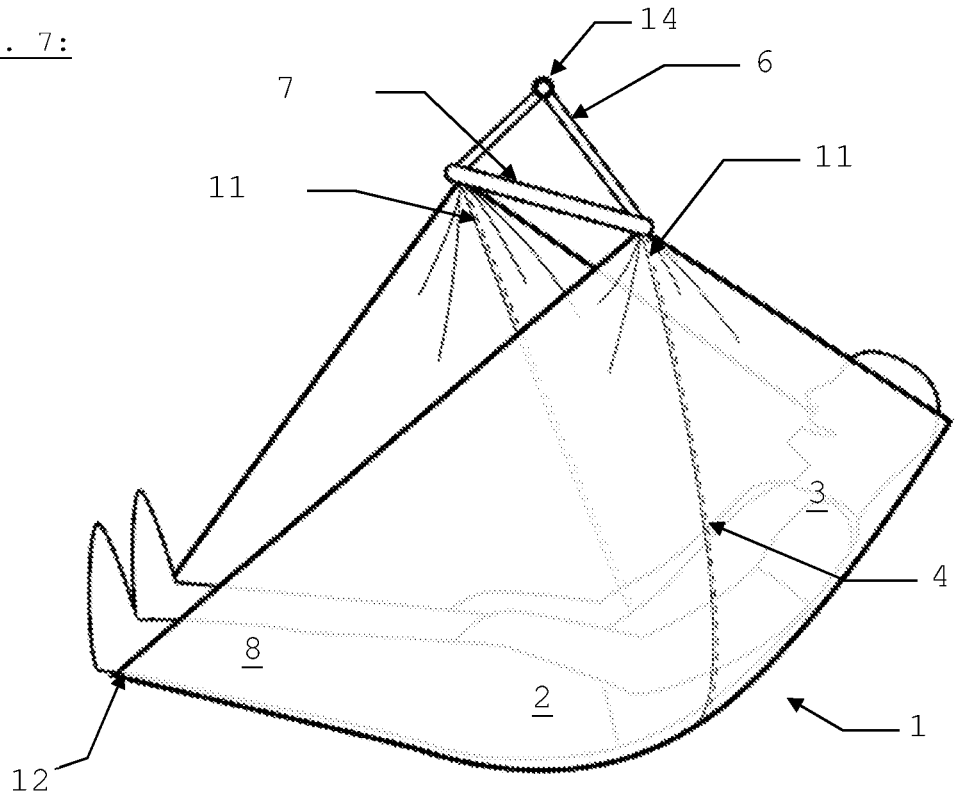

The hanging chair according to the invention will be described in more detail below with reference to drawings, in which FIG. 1 shows a base section of the hanging chair surface 1 consisting of seat and back surfaces 2, 3 of the hanging chair 1, FIG. 2 shows a base section of the hanging chair surface 1 comprising seat surface 2, back surface 3 and extension portion 8 of the hanging chair 1, FIG. 3 shows the hanging chair surface 1 consisting of seat surface 2 and back surface 3 with lateral gatherings 11 of the drawstring tunnels 5, FIG. 4 shows the hanging chair 1 according to the invention arranged on a spreading stick 7, comprising a seat surface 2 and back surface 3 in the suspended state, FIG. 5 shows a hanging chair surface 1 comprising the seat surface 2, back surface 3 and the extension portion 8 with lateral gatherings 11 at the drawstring tunnels 5, FIG. 6 shows the hanging chair comprising a seat surface 2, back surface 3 and an extension portion 8, with unused extension portion 8, and FIG. 7 shows a hanging chair with a hanging chair surface 1 comprising the seat surface 2, back surface 3 and the extension portion 8, with the extension portion 8 used in the stretched-out state.

The figures illustrated in more detail below show advantageous embodiments of the invention in different variations. FIGS. 1 and 2 each show a plan view of the base section of the hanging chair surface 1. It should be emphasized here that FIG. 2 in particular illustrates a flatly laid-out base section and not for instance a step-like folding as the impression given by the perceived perspective profile of the lateral edges could lead one to believe.

It is rather the case that, as can be seen in FIG. 1, the back surface 3 extends as a trapezoidal attachment from the rectangular seat surface 2 while being arranged on the longitudinal edge. Extending on the lateral edges of the two surfaces 2 and 3 is a continuous drawstring tunnel 5 on which the holding string 6 is subsequently guided and leads to a gathering 11 of the hanging chair.

FIG. 2 illustrates the alternative with an extension portion 8. Here, too, there is a flatly laid-out base section with the above-explained surfaces 2 and 3, and also the extension portion 8 which is attached to the longitudinal edge of the seat surface 2 that is opposite to the back surface 3. By contrast with the back surface 3, said extension portion 8 widens toward its free longitudinal edge and thus likewise has a trapezoidal cross section.

The widening toward the free longitudinal edge 12 ensures that, when the holding string 6 is guided through the continuously arranged drawstring tunnels 5 on all lateral edges of the interconnected surfaces, the extension portion 8 does not, like the back surface 3, extend angled at an inclination toward the vertical but, by contrast, has a tendency to remain in the horizontal by virtue of the widening toward the longitudinal edge 12. This is, moreover, illustrated in more detail in FIG. 7.

In addition, this base section has the effect that this profile of the surfaces 2, 3 and 8 is achieved without additional lateral suspension cords. The increased safety of the hanging chair thus achieved also becomes clear in FIGS. 3 to 7, since the risk of injuries on suspension cords, for example during use by children, is reduced.

FIGS. 3 to 7 reveal what shaping is achieved by the base section according to the invention of the hanging chair surface 1 in the suspension according to the use. Here, FIG. 3 illustrates the first embodiment with a seat surface 2 and back surface 3, with suspension strings 6 (not shown), guided through the drawstring tunnels 5, which can likewise no longer be seen in these drawings, being gathered there, resulting in the gathering 11 according to the invention on both transverse sides of the hanging chair. As illustrated in FIG. 3, this means that, by virtue of the gathering 11, the trapezoidal back surface 3 which tapers toward its upper free end facing the head has a steeper profile inclined toward the vertical by comparison with the approximately horizontally extending seat surface 2.

There can also be seen in all figures the connecting seam 4 between the different surface portions of the hanging chair surface 1. In all figures, this connecting seam 4 connects the seat surface 2 and back surface 3. As can be readily seen in FIG. 4, this means that is precisely at this connecting seam 4 that there occurs the deflection of the back surface 3 of the hanging chair surface 1 from the approximately horizontal seat surface 2 to a more vertical position.

It can additionally be observed from FIGS. 1 and 2 that the connecting seams 4 and 4' can be present in different combinations, and also design forms without connecting seams 4 and 4' are intended to be disclosed. In addition to the illustrated design form in FIG. 1 consisting of seat and back surfaces 2, 3 with connecting seam 4, a design form which is not graphically illustrated is correspondingly also covered in which the seat and back surfaces 2, 3 are produced in one part and thus without connecting seam 4.

With regard to FIG. 2, the alternative design form which is not graphically illustrated is also covered in which the seat surface 2, back surface 3 and extension portion 8 of the hanging chair 1 are produced in one part and thus without connecting seams 4 and 4'. Moreover, the design forms which are not graphically illustrated in which the seat surface 2, back surface 3 and extension portion 8 have only either the connecting seam 4 between the seat and back surfaces 2, 3 or the connecting seam 4' between the seat surface 2 and extension portion 8 are intended to be covered.

Also not illustrated graphically, there is the possibility here of using this combination of a plurality of surfaces also to employ different textile materials to produce the hanging chair and thus combining desired material properties with one another here, for example using textiles of different thickness or elasticity.

In FIGS. 5 to 7, then, there can be seen the expanded design form with extension portion 8. In the design form illustrated, the construction involved here is one in which the hanging chair surface 1 is obtained from two interconnected portions without the extension portion 8 being connected to the seat surface 2 by a separate connecting seam. Rather, what is concerned here is a continuous base section between the extension portion 8 and the seat surface 2.

By virtue of the widening of the extension portion 8 toward its free longitudinal edge 12, which, during the use of the hanging chair, faces the feet of the person sitting in the hanging chair, this extension portion results approximately in a horizontally extending continuation of the seat surface 2, as can readily be seen in FIG. 7.

As an alternative to this, FIG. 6 shows that a hanging chair with an extension portion 8 can also be used in a similar manner to what is illustrated in FIG. 4 for the hanging chair without extension portion 8. In other words, if the legs of the person using the hanging chair are not placed in the extension portion 8, the latter, as illustrated here, gathers for example in the region of the backs of the knees of the person using the hanging chair. Corresponding gathering folds 13 can be seen here in FIG. 6 and reproduce the rucking-up of the extension portion in this region. It is only when the calves and feet of the person using the hanging chair are placed in the extension portion 8 that one arrives at illustration 7 in which the stretched-out extension portion 8 leads in a pleasant manner to an approximately horizontally extending support of the legs of the person using the hanging chair.

As can be seen in FIGS. 4, 6 and 7, the spreading stick 7 results in the hanging chair being held open between the gatherings 11, thus making it easily possible to enter and exit the hanging chair.

In addition, the suspension strings 6 are guided through the drawstring tunnels 5 and then brought together through the spreading stick 7 to a common suspension point 14. There is provision here that a removal of the hanging chair from the spreading stick is also envisioned in order for example to allow a cleaning or washing, a repair or a replacement of the hanging chair surface.

The invention claimed is:

1. A hanging chair, comprising:

a spreading stick, a hanging chair surface, suspension strings, and drawstring tunnels on the hanging chair surface for receiving the suspension strings, wherein a base section of the hanging chair surface of the hanging chair has at least one approximately rectangular seat surface and a trapezoidal back surface attached to the seat surface, a trapezoidally widening extension portion is attached to an edge of the seat surface that is opposite to a connection of the seat surface with the back surface, the extension portion, on account of the trapezoidal widening in a suspended laterally gathered state of the hanging chair, continues the seat surface approximately horizontally and adapted to support stretched-out legs of a person using the hanging chair, the seat surface, back surface and extension portion have common lateral drawstring tunnels on each lateral edge of the hanging chair surface for string guidance and fastening to the spreading stick, these lateral drawstring tunnels bring out, by the suspension strings guided therein, a gathering of an entire length of each lateral edge of the hanging chair surface, and these gatherings on the hanging chair, when suspended, form a steeper profile of the back surface with respect to a flatter extending profile of the seat surface.

2. The hanging chair having a spreading stick as claimed in claim 1, wherein the at least one approximately rectangular seat surface is connected to the approximately trapezoidal back surface via a connection seam, and the gathering occurring during the suspension of the hanging chair on the spreading stick forms a transitioning of the flat seat surface into the steeper extending back surface, in particular in the region of the connecting seam between the seat and back surfaces.

3. The hanging chair having a spreading stick as claimed in claim 1, wherein the extension portion is also joined to the seat surface via a connecting seam as a distinct element.

4. The hanging chair having a spreading stick as claimed in claim 1, wherein textile materials which differ in at least one of their elasticity, structure, material thickness, surface nature, or color are used to form the seat surface, the back surface, and the extension portion.

5. The hanging chair having a spreading stick as claimed in claim 1, wherein the hanging chair surface of the hanging chair is designed to be completely removable from the spreading stick and can thus be easily cleaned or replaced.

* * * * *